US010605565B1

(12) United States Patent
Geissele et al.

(10) Patent No.: US 10,605,565 B1
(45) Date of Patent: Mar. 31, 2020

(54) ADJUSTABLE REAR SIGHT FOR A FIREARM

(71) Applicant: WHG Properties, LLC, North Wales, PA (US)

(72) Inventors: William H. Geissele, Lower Gwynedd, PA (US); Frank E. Robinson, Schwenksville, PA (US)

(73) Assignee: WHG Properties, LLC, North Wales, PA (US)

( * ) Notice: Subject to any disclaimer, the term of this patent is extended or adjusted under 35 U.S.C. 154(b) by 0 days.

(21) Appl. No.: 16/249,461

(22) Filed: Jan. 16, 2019

(51) Int. Cl.
*F41G 1/26* (2006.01)
*F41G 1/08* (2006.01)
*F41G 11/00* (2006.01)

(52) U.S. Cl.
CPC ..... *F41G 1/26* (2013.01); *F41G 1/08* (2013.01); *F41G 11/003* (2013.01)

(58) Field of Classification Search
CPC ..... F41G 1/26; F41G 1/08; F41G 11/003
USPC ..... 42/148, 135–138
See application file for complete search history.

(56) References Cited

U.S. PATENT DOCUMENTS 229,245 A * 6/1880 Freund ..... F41G 1/473 42/111
264,899 A * 9/1882 Prior ..... F41G 1/17 42/140
308,699 A * 12/1884 Rabbeth ..... F41G 1/17 42/140
396,043 A * 1/1889 Lyman ..... F41G 1/17 42/140
404,599 A * 6/1889 Carver ..... F41G 1/17 42/140
494,240 A * 3/1893 Barringer ..... F41G 1/08 42/133
561,360 A * 6/1896 Taylor ..... F41G 1/17 42/140
805,770 A * 11/1905 Bassell ..... F41G 1/17 42/140
878,857 A * 2/1908 Bevier ..... F41G 1/28 42/136
939,085 A * 11/1909 Powell ..... F41G 1/473 42/111
1,034,925 A * 8/1912 Newitt ..... F41G 1/17 42/140
1,089,009 A * 3/1914 Porter ..... F41G 1/02 42/148
1,198,295 A * 9/1916 Ward ..... F41G 1/28 42/136
1,206,060 A * 11/1916 Warner ..... F41G 1/28 42/136
1,257,713 A * 2/1918 Johnson ..... F41G 1/26 42/137
1,363,553 A * 12/1920 Barringer ..... F41G 1/12 42/145

(Continued)

*Primary Examiner* — Michelle Clement
(74) *Attorney, Agent, or Firm* — Fox Rothschild LLP

(57) ABSTRACT

The disclosure relates to an adjustable rear iron sight for a firearm. The rear iron sight includes features that maintain its various components in a state of alignment, that permit the rear iron sight to be locked in raised and lowered positions, and that bias a dual aiming aperture against movement while nevertheless permitting the user to easily rotate the dual aiming aperture to switch between its large-diameter and small-diameter apertures.

27 Claims, 8 Drawing Sheets

(56) References Cited

U.S. PATENT DOCUMENTS 1,433,422 A * 10/1922 Spencer ..... F41G 1/02 42/140
1,450,823 A * 4/1923 Spencer ..... F41G 1/02 42/136
1,602,116 A * 10/1926 Manahan ..... F41G 1/14 42/125
1,908,019 A * 5/1933 Howard ..... F41G 1/17 42/139
2,032,648 A * 3/1936 Bliss ..... F41G 1/28 42/136
2,276,446 A * 3/1942 Zimmerman ..... F41G 1/033 42/140
2,331,903 A * 10/1943 Garand ..... F41G 1/17 42/140
2,334,300 A * 11/1943 Williams ..... F41G 1/17 42/140
2,434,712 A * 1/1948 Mossberg ..... F41G 1/16 42/136
2,437,363 A * 3/1948 Smith ..... F41G 1/17 42/140
2,438,601 A * 3/1948 Davis ..... F41G 1/26 42/137
2,511,245 A * 6/1950 Caster ..... F41G 1/28 42/137
2,531,421 A * 11/1950 Garand ..... F41G 1/18 42/137
2,585,395 A * 2/1952 Martin ..... F41G 1/26 42/137
2,585,933 A * 2/1952 Harvey ..... F41G 1/17 42/137
2,645,017 A * 7/1953 Haase ..... F41G 1/02 42/111
2,724,897 A * 11/1955 Hough ..... F41G 1/17 42/140
2,871,566 A * 2/1959 Everitt ..... F41G 1/00 42/137
2,939,217 A * 6/1960 Hajek ..... F41G 1/06 42/148
2,963,789 A * 12/1960 Wilhelm ..... F41G 1/26 42/137
3,190,002 A * 6/1965 Bliss ..... F41G 1/01 33/228
3,192,632 A * 7/1965 Von Stavenhagen ..... F41G 1/02 42/144
3,495,339 A * 2/1970 Elliason ..... F41G 1/26 42/137
3,662,469 A * 5/1972 Charron ..... F41G 1/26 42/137
3,930,316 A * 1/1976 Tellie ..... F41G 1/08 42/140
3,961,423 A * 6/1976 Hrebar ..... F41G 1/00 42/137
3,969,827 A * 7/1976 Ellis ..... F41G 1/065 42/136
4,017,995 A * 4/1977 Hughes, Jr. ..... F41G 1/26 42/136
4,200,989 A * 5/1980 Brouthers ..... F41G 1/26 42/137
4,208,821 A * 6/1980 Power ..... F41G 1/28 42/138
4,479,307 A * 10/1984 Pomeranz ..... F41G 1/26 42/133
4,597,211 A * 7/1986 Miles ..... F41G 1/52 42/111
4,606,131 A * 8/1986 Domian ..... F41G 1/16 42/137
4,663,878 A * 5/1987 Beretta ..... F41C 33/08 42/148
4,691,442 A * 9/1987 Center ..... F41G 1/17 42/135
4,993,158 A * 2/1991 Santiago ..... F41G 1/32 42/135
5,327,654 A * 7/1994 Parker ..... F41G 1/01 42/136
5,533,292 A * 7/1996 Swan ..... F41G 1/16 42/123
5,822,872 A * 10/1998 Waki ..... F41G 1/12 42/111
6,418,657 B1 * 7/2002 Brown ..... F41G 1/26 42/124
6,490,822 B1 * 12/2002 Swan ..... F41C 23/00 42/124
6,606,813 B1 * 8/2003 Squire ..... F41C 27/00 248/201
6,615,530 B2 * 9/2003 Johansson ..... F41G 1/17 42/133
6,622,415 B1 * 9/2003 Canaday ..... F41G 1/26 42/112
6,722,075 B1 * 4/2004 Gabaldon ..... F41G 1/01 42/136
6,732,467 B1 * 5/2004 Luth ..... F41G 1/16 42/138
6,779,290 B1 * 8/2004 Houtsma ..... F41G 1/08 42/111
6,968,643 B2 * 11/2005 Woodbury ..... F41G 1/033 42/137
7,032,341 B1 * 4/2006 Sconce ..... F41G 1/18 42/111
7,076,907 B2 * 7/2006 Nesseth ..... F41G 1/17 42/111
D526,380 S * 8/2006 Swan ..... D22/109
7,181,882 B2 * 2/2007 Woodbury ..... F41G 1/033 42/137
7,526,890 B1 * 5/2009 Keng ..... F41G 1/18 42/111
D594,083 S * 6/2009 Mayberry ..... D22/109
D637,259 S * 5/2011 Swan ..... D22/109
7,946,074 B2 * 5/2011 Nemec ..... F41G 1/01 42/113
8,015,744 B1 * 9/2011 Swan ..... F41G 1/065 42/133
8,069,607 B2 * 12/2011 Ballard ..... F41G 1/033 42/111
D728,728 S * 5/2015 Barfoot ..... D22/109
D736,339 S * 8/2015 Fitzpatrick ..... D22/109
9,733,045 B1 * 8/2017 Bozek ..... F41G 1/16
D820,921 S * 6/2018 Chu ..... D21/573
10,119,784 B1 * 11/2018 Ding ..... F41G 1/033
2002/0152663 A1 * 10/2002 Carrier, III ..... F41G 1/26 42/136
2003/0140546 A1 * 7/2003 Kay ..... F41G 1/033 42/133
2005/0188602 A1 * 9/2005 Swan ..... F41G 1/065 42/147
2006/0207157 A1 * 9/2006 Keng ..... F41G 1/32 42/132
2008/0092424 A1 * 4/2008 Keng ..... F41G 1/18 42/137
2008/0276520 A1 * 11/2008 Ballard ..... F41G 1/08 42/143
2009/0188147 A1 * 7/2009 Schwerman ..... F41G 1/08 42/148
2010/0236389 A1 * 9/2010 Larson ..... F41C 33/08 89/1.42
2011/0219657 A1 * 9/2011 Ash, Jr. ..... F41C 27/00 42/90
2011/0296734 A1 * 12/2011 Troy ..... F41G 1/17 42/135
2012/0060402 A1 * 3/2012 Dueck ..... F41G 1/02 42/137
2012/0180368 A1 * 7/2012 Haley ..... F41G 1/02 42/132
2015/0128471 A1 * 5/2015 Troy ..... F41G 1/08 42/111
2015/0198414 A1 * 7/2015 Raybman ..... F41G 1/17 42/111
2015/0198415 A1 * 7/2015 Campean ..... F41G 1/18 42/137

(56) References Cited

U.S. PATENT DOCUMENTS

| | | | | |
|---|---|---|---|---|
| 2015/0369564 | A1* | 12/2015 | Wilson | F41G 11/003 42/111 |
| 2016/0102941 | A1* | 4/2016 | Brucker | F41G 1/17 42/148 |
| 2017/0350674 | A1* | 12/2017 | Odle | F41G 1/01 |
| 2018/0073839 | A1* | 3/2018 | Crispin | F41G 11/001 |
| 2018/0306552 | A1* | 10/2018 | Kung | F41G 1/033 |
| 2019/0017784 | A1* | 1/2019 | Smith | F41G 11/003 |

* cited by examiner

ADJUSTABLE REAR SIGHT FOR A FIREARM

BACKGROUND

Virtually all firearms are equipped with some type of sighting system to facilitate aiming the weapon. Examples of typical sighting systems include telescopic sights, holographic sights, laser sights, and iron sights. Iron sights, sometimes referred to as open sights or back up iron sights, may include a front iron sight and a rear iron sight through which the firearm user aligns his/her line of sight with a desired target. Iron sights may be fixed or adjustable. Fixed iron sights can be integrally machined into the firearm, whereas adjustable iron sights can be adjusted for elevation (vertical adjustment) or windage (horizontal adjustment).

It is critical to not only properly adjust the sights with respect to a desired target, but also to maintain that precise adjustment each time the weapon is fired. Even a very small deviation in the positioning of the sights will result in the fired projectile having a trajectory that diverges from the intended target relative to the distance from that target. Also, iron sights generally need to be compact, particularly when the iron sight is used as part of a secondary sighting system. Maintaining a compact configuration can be a challenge, however, in applications where the iron sight needs to be folded into a stored position, where the iron sight needs to be adjustable for both elevation and windage, and/or where the iron sight is equipped with a dual aiming aperture. Thus, there is a need for iron sights that are highly durable, stable, precise, and secure, particularly for use in combat or environments where the weapon may be subject to impact or rough handling conditions.

SUMMARY

In one aspect, the disclosed technology relates to a rear sight for a firearm, including: a first bracket; a second bracket; an elevation drum mounted on and restrained by the first bracket and configured to engage the second bracket so that rotation of the elevation drum in relation to the second bracket varies a position of the second bracket in relation to the first bracket in a first direction; and an aiming aperture mounted on the second bracket, wherein the first or second bracket includes an alignment member configured to engage the first or second bracket to maintain the first and second brackets in alignment as the position of the second bracket in relation to the first bracket is varied. In one embodiment, the alignment member includes an extension from the second bracket. In another embodiment, the extension is a substantially planar member; the first bracket includes a first rail and a second rail; wherein the first and second rails and an adjacent surface of the first bracket define a recess that receives the extension; the first and the second rails are configured to restrain the extension in a second direction substantially perpendicular to the first direction when the extension is positioned within the recess; and the first and second rails and the adjacent surface are configured to restrain the second bracket in a third direction substantially perpendicular to the first and second directions when the extension is positioned within the recess.

In another embodiment, the extension is elongated in the first direction. In another embodiment, the alignment member further includes a second extension on the second bracket; and the first bracket further includes a third and a fourth rail. In another embodiment, the second bracket includes a first shaft extending substantially in the first direction and having threads on an exterior surface thereof; the elevation drum includes a second shaft extending substantially in the first direction and having threads on an interior surface thereof; and the elevation drum threadably engages the second bracket by way of the first and second shafts. In another embodiment, the second bracket includes a body, and the alignment member extends from the body. In another embodiment, the rear sight further includes a third shaft mounted for rotation on the body of the second bracket; wherein the aiming aperture is threadably engages the shaft and is configured to move in a second direction substantially perpendicular to the first direction in response to rotation of the shaft.

In another embodiment, the aiming aperture includes a first and a second aperture defined therein; the aiming aperture is configured to rotate in relation to the second bracket between a first angular position and a second angular position; and the rear iron sight further includes a button member configured to inhibit the rotational movement of the aiming aperture between the first and second angular positions. In another embodiment, the button member includes a substantially planar first portion configured to contact the aiming aperture, and a substantially cylindrical second portion adjoining the first portion; and the rear iron sight further includes a spring disposed within the first shaft and configured to bias the button member toward the aiming aperture. In another embodiment, the body includes a recess formed therein and configured to receive the first portion of the button member. In another embodiment, the aiming aperture includes: a first outer surface configured to contact the first portion of the button member when the aiming aperture is in the first angular position; a second outer surface configured to contact the first portion of the button member when the aiming aperture is in the second angular position; and a third outer surface adjoining each of the first and second outer surfaces at a obtuse angle. In another embodiment, the rear iron sight further includes a rail mount including a base, a clamp, and a rail pin; the first bracket is coupled to the base and is configured to rotate between a first position corresponding to a locked lowered position of the rear iron sight, and a second position corresponding to a raised locked position of the rear iron sight; and the first bracket and a locking portion of the base are configured to interlock when the first bracket is disposed in each of the first and second positions, and the interlocking of the first bracket and the locking portion prevents rotation of the first bracket between the first and second positions. In another embodiment, the rear sight further includes a locking mechanism having an axle and a biasing element; wherein the biasing element is configured to bias the first bracket and the locking portion of the base into interlocking engagement when the first bracket is located in each of the first and second positions. In another embodiment, the biasing element is further configured to compress and deflect when a force is applied to the first bracket; and the first bracket and the locking portion are further configured so that the deflection of the biasing element releases the first bracket and the locking portion from interlocking engagement thereby permitting the first bracket to rotate between the first and second positions.

In another embodiment, the first bracket includes a projection; the locking portion of the base includes a first slot formed therein and configured to receive a portion of the projection when the first bracket is located in the first position; and the engagement of the locking portion and the first bracket by way of the projection and the second slot locks the first bracket in the first position. In another embodiment, the locking portion of the base includes a second slot formed therein and configured to receive the portion of the projection when the first bracket is located in the second position; and the engagement of the locking portion and the first bracket by way of the projection and the second slot locks the first bracket in the second position. In another embodiment, the first bracket and the locking portion of the base are configured so that the deflection of the biasing member permits the projection to back out of the first and the second slots. In another embodiment, the rail pin and the clamp are configured to secure the base to a rail of a firearm.

In another aspect, the disclosed technology relates to a firearm including a rear iron sight disclosed herein.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Various non-limiting embodiments will be described in detail with reference to the drawings, wherein like reference numerals represent like parts and assemblies throughout the several views.

DETAILED DESCRIPTION

The present disclosure generally relates to a rear iron sight capable of being adjusted for elevation and windage. References to various embodiments and examples set forth in this specification do not limit the scope of the disclosure and merely set forth some of the many possible embodiments of the appended claims. Directional terms such as "upper," "lower," "above," "beneath," etc., unless otherwise noted, are used with reference to the component orientations depicted in the figures. These terms are used for illustrative purposes only, and are not intended to limit the scope of the appended claims.

Figure 10:
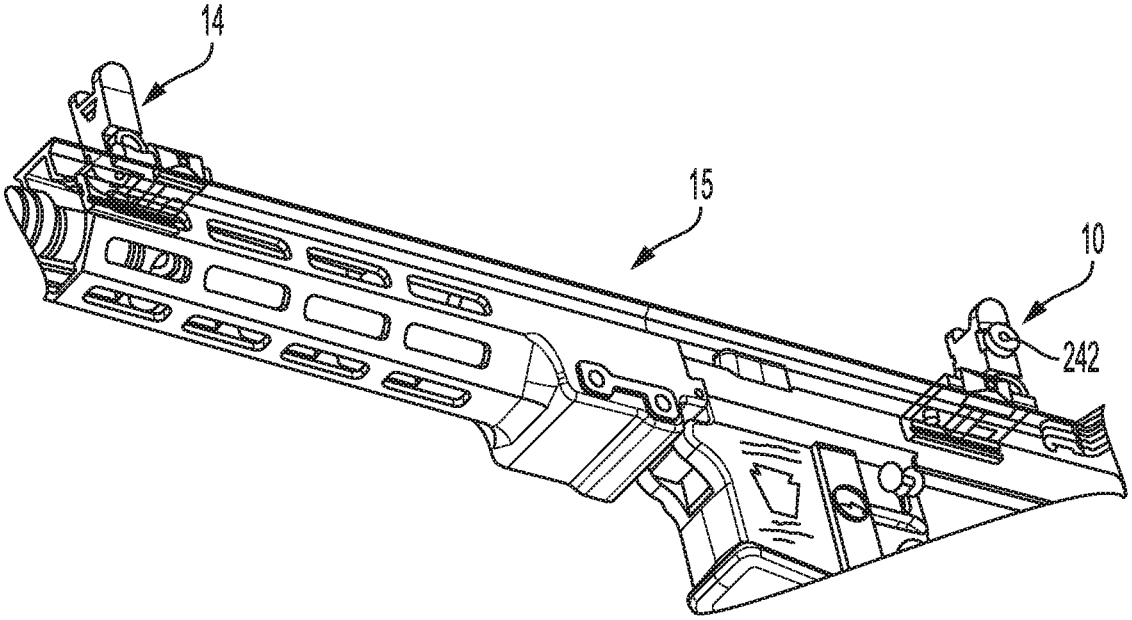
FIG. 10 is a front-left-bottom perspective view of the rear iron sight of FIG. 1 along with a foldable front iron sight, both installed on a firearm rail and depicted in raised locked positions.
Figure 11:
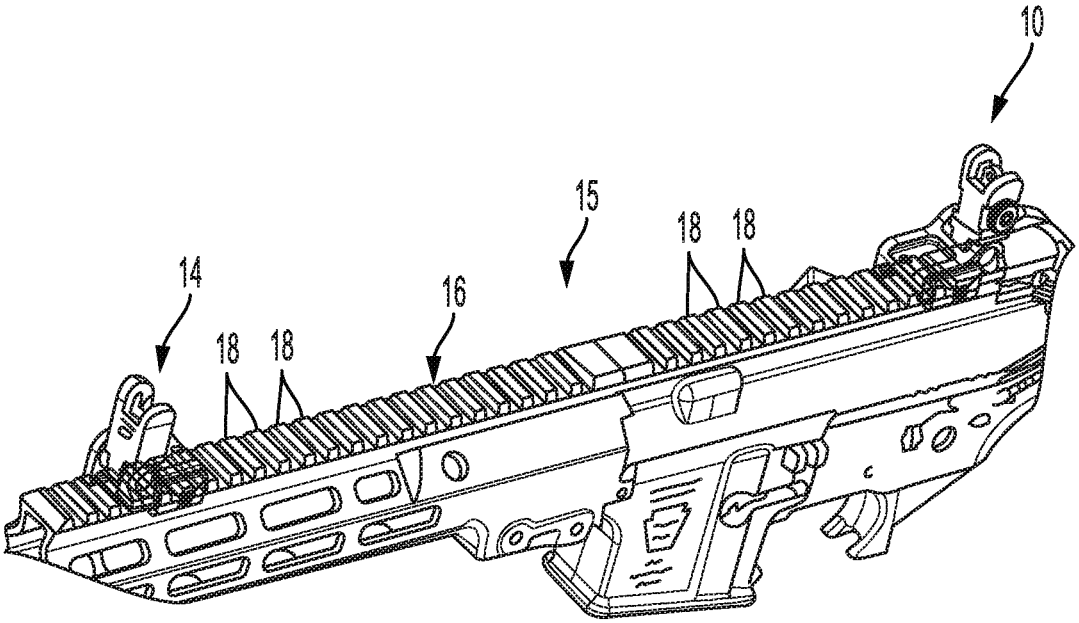
FIG. 11 is a front-left-top perspective view of the rear iron sight of FIG. 1 along with a foldable front iron sight, both installed on a firearm rail and depicted in raised locked positions.
Figure 12:
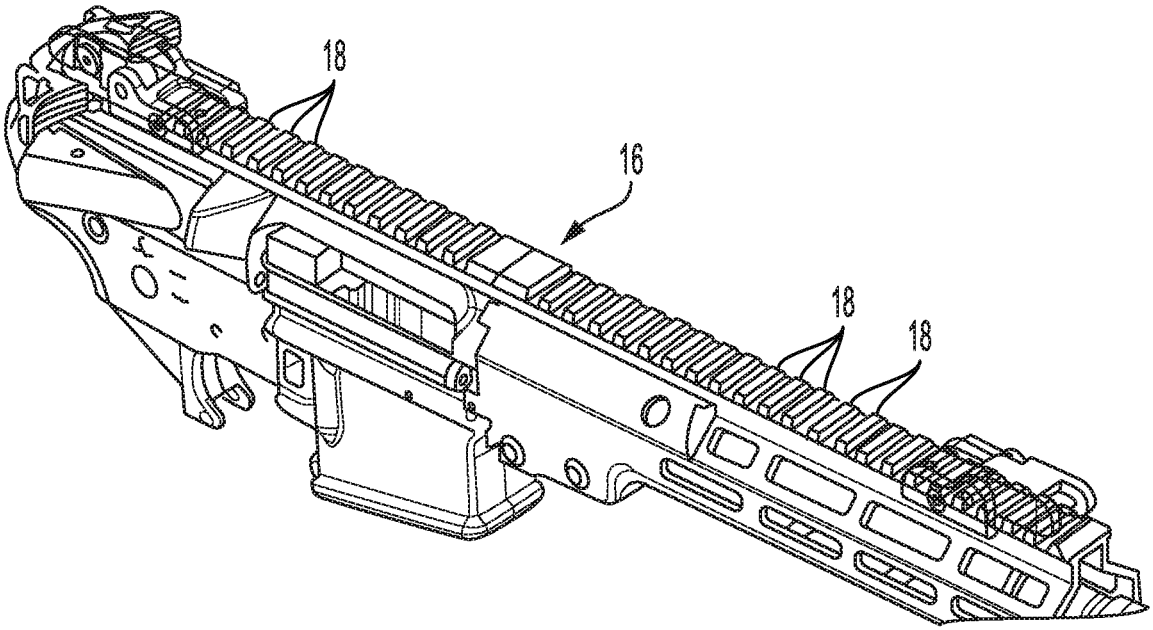
FIG. 12 is a front-right-top perspective view of the rear iron sight of FIG. 1 along with a foldable front iron sight, both installed on a firearm rail and depicted in lowered locked positions.

The figures depict a rear iron sight 10 that is capable of being adjusted for both elevation and windage. The rear iron sight 10 can be used by itself, or in conjunction with a front iron sight 14 as shown in FIGS. 10-12. The front iron sight 14 can be, for example, a foldable front iron sight as disclosed in U.S. patent application Ser. No. 16/244,298, which is hereby incorporated by reference in its entirety. Alternatively, the rear iron sight 10 may be used in conjunction with other types of front iron sights. FIGS. 10-12 show the rear iron sight 10 mounted on a rail of a rifle 15 for illustrative purposes only. The rear iron sight 10 may be mounted on and used in connection with a variety of types of firearms. As used herein, the term "iron sight" refers to a sight, without limitation on the type of material from which the sight is made.

The rear iron sight 10 may be a foldable dual-aperture rear iron sight. In one embodiment disclosed herein, the rear iron sight 10 may be used as a back-up sight to supplement a primary sighting system (not shown) of the rifle 15. The rear iron sight 10 can fold downwardly, into a lowered position as shown in FIG. 12, which protects the rear iron sight 10 from damage and provides a lower profile when the rear iron sight 10 is not needed by the user. When needed by the user, such as when the primary sighting system becomes damaged, unavailable or otherwise fails, the rear iron sight 10 can unfold or flip up into a raised position as shown in FIGS. 1-11. In some embodiments, the rear iron sight 10 may constitute part of a primary sighting system.

The rear iron sight 10 may be formed separately from the rifle 15, and can be attached to a mounting rail 16 of the rifle 15 as discussed below. In some embodiments, one or more components of the rear iron sight 10 are formed unitarily with the mounting rail 16 or other part(s) of the rifle 15. The rear iron sight 10 may be adjusted into two or more different locked positions, as described below.

Figure 1:
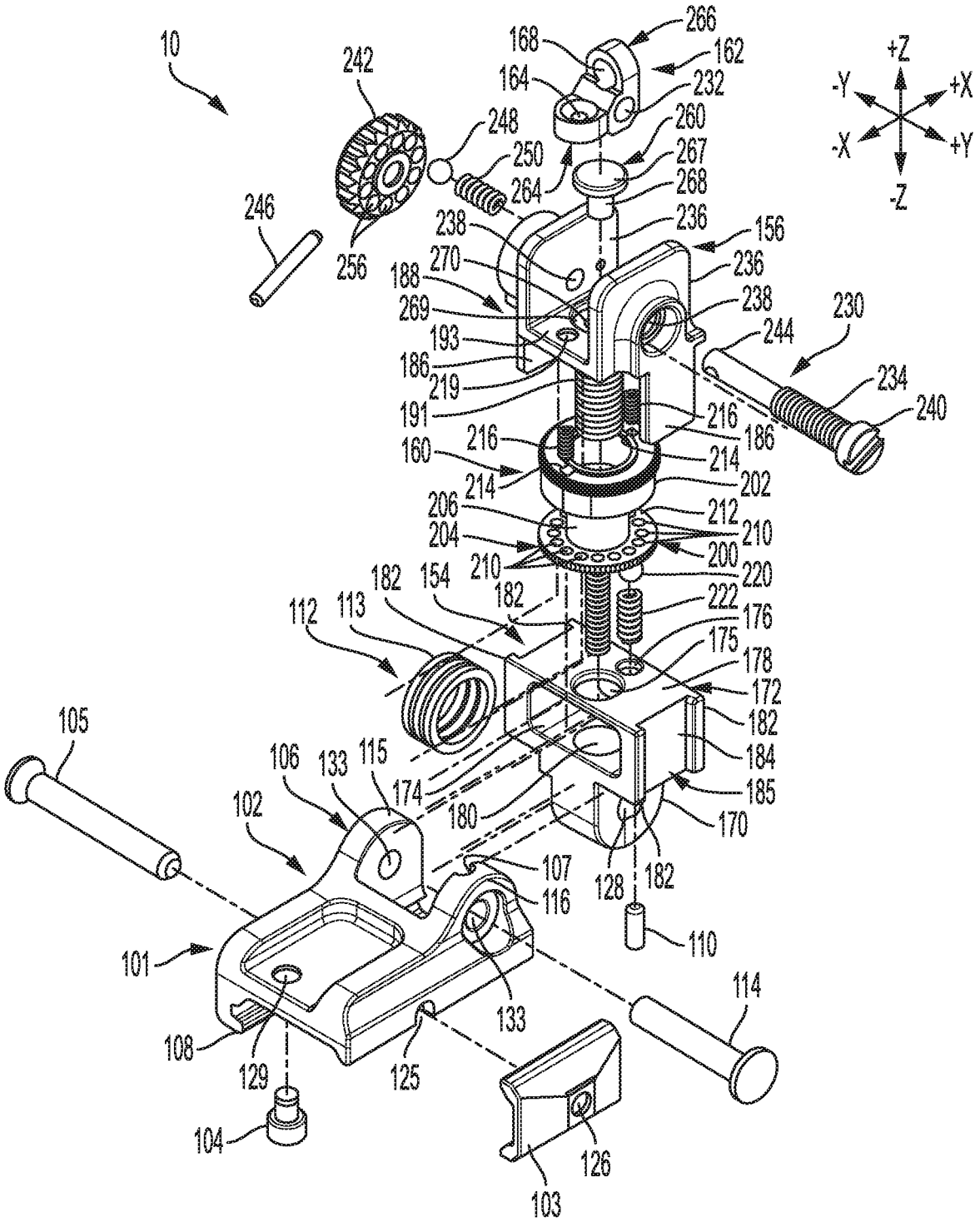
FIG. 1 is an exploded perspective view of an adjustable rear iron sight in accordance with the present disclosure.

The rear iron sight 10 can be attached to the mounting rail 16 of the rifle 15 as follows. As a non-limiting example, the mounting rail 16 can be a Picatinny style mounting platform known as a Picatinny rail or a MIL-STD-1913. Referring to FIG. 1, the rear iron sight 10 includes a rail mount 101 that includes a base 102, a clamp 103, a stopper 104, and a rail pin 105. The base 102 includes a base locking portion 106. As used herein, the term "pin" (e.g., rail pin, slot pin, etc.) refers to a round pin, screw, square pin, flat pin, solid cylindrical pin, tapered pin, groove pin, spring pin, or any other shaped component or structure that would serve the relevant purpose described herein.

The rail mount 101 can be mounted on the mounting rail 16, as depicted in FIGS. 10-12. At least a portion of the rail pin 105 is positioned snugly within a groove 18 in the rail 16, to hold the rail mount 101 in place. The clamp 103 includes an aperture 126, and the base 102 includes apertures 125 located on opposite sides of the base 102. The apertures 125, 126 are aligned when the rear iron sight 10 is mounted on the rail 16. The rail pin 105 is configured to fit within and through the aperture 125 on one side of the base 102, to extend across the underside of the base 102, and to fit within and through the aperture 125 on the opposite side of the base 102 and the adjacent aperture 126 of the clamp 103. The rail pin 105 can be secured in the aperture 126 by a press fit, threaded connection, or other suitable means.

As shown in FIG. 1, the base 102 also may include a rail holder portion 108 that aligns with an outer portion of the rail 16, below the groove 18, to further secure the rail mount 101 to the rail 16. The rail pin 105, rail holder portion 108, base 102, and clamp 103 collectively secure the rear iron sight to the rail 16.

Additionally, to further secure the base 102 of the rail mount 101 to the rail 16, the stopper 104 can be configured to fit within an aperture 129 of the base 102; and also to snugly fit within a groove 18 of the rail 16 adjacent to the particular groove 18 within which the rail pin 105 is positioned. The stopper 104 can have a variety of shapes and sizes configured to fit into the aperture 129 of the base 102, and to also fit snugly into the adjacent groove 18. The apertures in the clamp 103 and base 102 of the rail mount 101, and the rail pin 105 can have a variety of corresponding sizes and shapes, e.g., rounded, provided they are collectively configured to align and serve the purpose described herein.

The lower bracket 154 is configured to interface with the base locking portion 106 so as to rotatably couple the remainder of the rear iron sight 10 to the rail mount 101. The rear iron sight 10 includes a locking mechanism, such as a spring assisted locking mechanism 112 discussed below, to secure the lower bracket 154 in its raised and lowered positions. As discussed below, when the lower bracket 154 is in the raised locked position shown in FIGS. 1-11, a force may be applied to the locking mechanism 112 to unlock the lower bracket 154 and thereby allow the lower bracket 154 to be rotated to a lowered locked position shown in FIG. 12. Similarly, when the lower bracket 154 is in the lowered locked position, a force may be applied to the locking mechanism 112 to unlock the lower bracket 154 and allow the lower bracket 154 to be rotated to its raised locked position.

Figure 9:
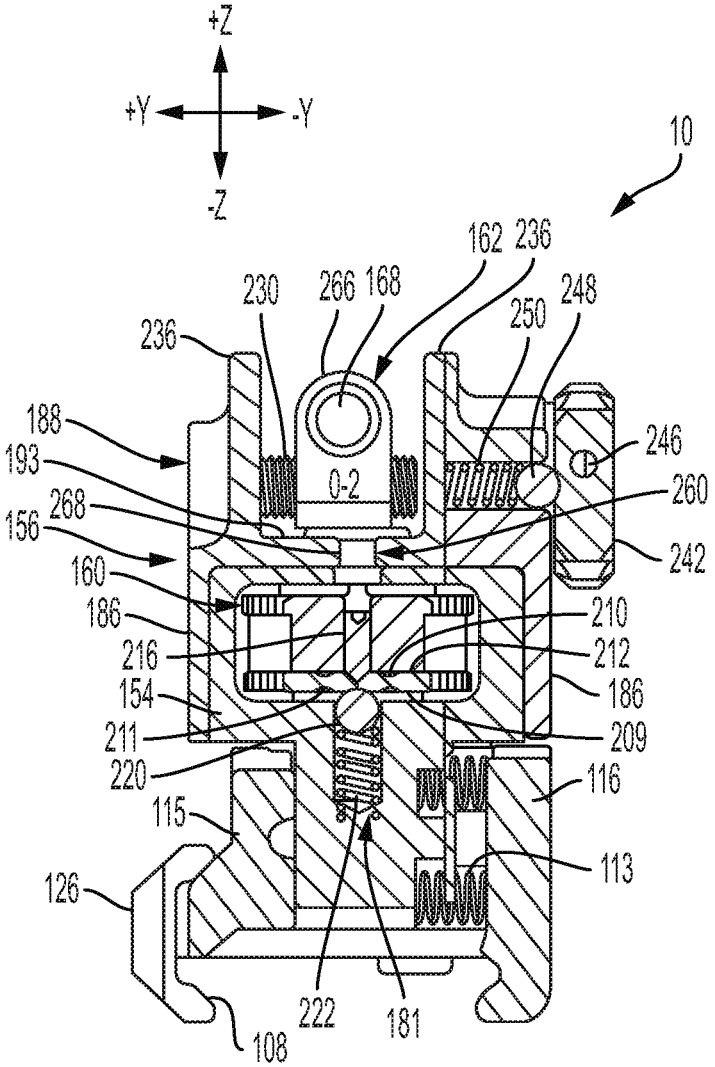
FIG. 9 is a cross-sectional view of the rear iron sight of FIG. 1, taken through the line "G-G" of FIG. 4, depicting the iron sight in a raised locked position.

The locking mechanism 112 includes a biasing element 113 and an axle 114. As shown in FIGS. 1 and 9, the biasing element 113 is a spring, but any other biasing structure capable of serving the same purpose described herein can be used as in the alternative. In some embodiments, the biasing element 113 is a spring having a desired spring force. For example, the desired spring force may be about 7 pounds to about 11 pounds, such as about 8 pounds to about 10 pounds, or about 9 pounds.

As shown in FIG. 1, the axle 114 is shaped as a cylindrical body having two circular ends. The smaller-diameter, or second end is formed after the axle 114 has been installed in the base locking portion 106. In one embodiment, the second end, prior to installation, has a diameter matching that of the axle body. This feature permits the second end to be inserted through apertures 133 formed in first and second protruding portions 115, 116 located on opposite sides of the base locking portion 106. Once the axle 114 has been inserted, the second end is deformed by peening or another suitable process into a form, not shown in FIG. 1, in which the second end has a diameter larger than that of the apertures 133. Once deformed, the second end, along with the larger-diameter first end, which also has a diameter larger than that of the apertures 133, retains the axle 114 on the base locking portion 106.

In alternative embodiments, the first and second ends of the axle 114 can be formed in non-cylindrical and/or non-circular shapes that would serve the same retaining purpose described herein. In one embodiment disclosed herein, the diameter of the first end is larger than that of the second end after the second end has been deformed. The respective diameters of the first and second ends can be the same in other alternative embodiments.

The axle 114 is not removable after the second end has been deformed. In alternative embodiments, the axle 114 can be retained in a manner that permits the axle 114 to be removed. For example, the axle 114 can be formed with threads that permit the axle 114 to mate with a bolt or other feature that prohibits the axle 114 from backing out of the apertures 133.

Referring to FIG. 1, the rear iron sight 10 includes a first (e.g., lower) bracket 154 coupled to the base 102. The lower bracket 154 is configured to rotate in relation to the base 102 to facilitate folding of the sight 10 between the raised and lowered positions. The rear iron sight 10 further includes a second (e.g., upper) bracket 156, an elevation drum 160, and a dual aiming aperture 162. The upper bracket 156 is mounted on the lower bracket 154, and can be raised and lowered in relation to the lower bracket 154 via the elevation drum 160 to facilitate adjustment of the elevation setting for the rear iron sight 10.

Figure 7:
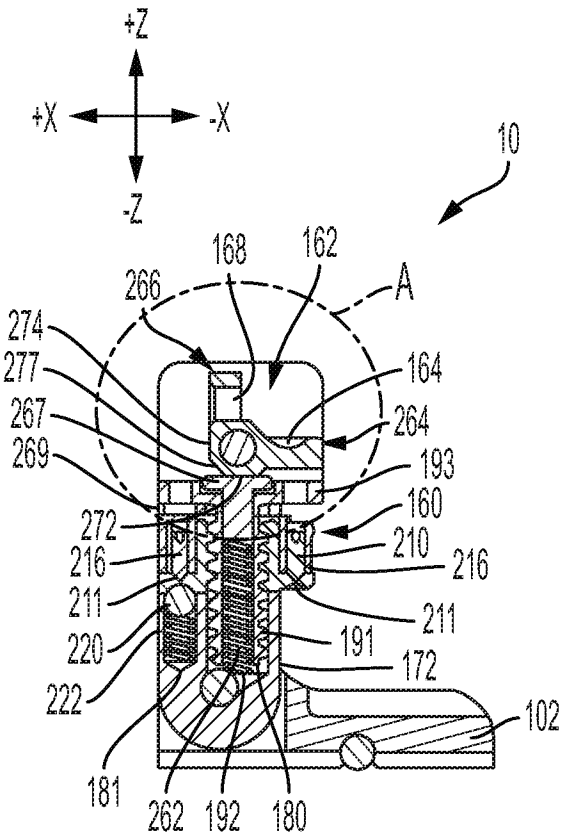
FIG. 7 is a cross-sectional view of the rear iron sight of FIG. 1, taken through the line "H-H" of FIG. 4, depicting the iron sight in a raised locked position with a dual aiming aperture depicted in a second position.
Figure 8:
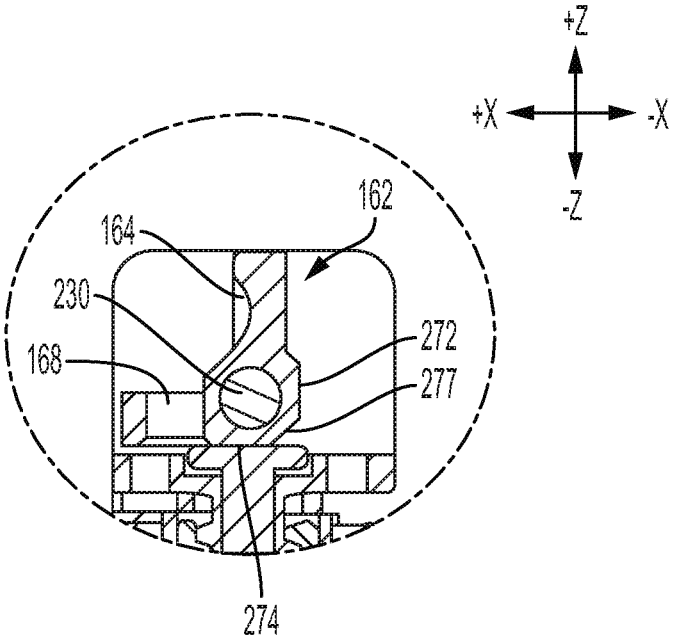
FIG. 8 is a cross-sectional view of the area designated "A" in FIG. 7, depicting the iron sight in a raised locked position with a dual aiming aperture depicted in a first position.

The dual aiming aperture 162 is mounted on the upper bracket 156, and is configured to rotate in relation to the upper bracket 156 between a first angular position (see FIGS. 1-5, 7, and 9) and a second angular position (see FIG. 8). When the aiming aperture 162 is in its first position, the user's line of sight will align with the first aperture 164. When the aiming aperture 162 is in its second position, the user's line of sight will align with the second aperture 168. Also, the aiming aperture 162 is movable in relation to the upper bracket 156 in a lateral ("y") direction to facilitate adjustment of the windage setting for the iron sight 10. As shown in FIGS. 1, 4, and 9, the dual aiming aperture 162 includes a first aperture 164 and a larger-diameter second aperture 168. In general, the first aperture 168 may be employed when aiming the rifle 15 over longer ranges (e.g., more than 200 yards), and the second aperture 168 may be employed when aiming the rifle 15 over shorter ranges (e.g., 200 yards or less). In some embodiments, the smaller-diameter first aperture has a diameter of about 0.05 inches to about 0.07 inches. In some embodiments, the larger-diameter second aperture has a diameter of about 0.19 inches to about 0.25 inches.

A first portion 170 of the lower bracket 154 may include a through hole 128 formed therein and extending in a lateral ("y") direction. The through hole 128 aligns with the apertures 133 of the first and second protruding portions 115, 116 of the base locking portion 106. The lower bracket 154 and the biasing element 113 are configured to fit within the space between the first and second protruding portions 115, 116, at a distal end of the base 102. The body of the axle 114 rotatably connects the base locking portion 106 to the lower bracket 154. The axle 114 extends through the following components: the aperture 133 of the first protruding portion 115, the biasing element 113, the through hole 128 of the lower bracket 154, and the aperture 133 of the second protruding portion 116.

In some embodiments, the lower bracket 154 includes a projection in the form of a slot pin 110, shown in FIG. 1. The slot pin 110 is secured in, and extends from a bore formed in the first portion 170 of the lower bracket 154. The slot pin 110 is positioned generally perpendicular to a longitudinal axis of the base 102, i.e., the slot pin 110 extends generally in the "z" direction, when the rear iron sight 10 is in its raised position. The base locking portion 106 includes a vertically-oriented first slot 107, visible in FIG. 1. The first slot 107 is aligned with, and receives the slot pin 110 when the rear iron sight 10 is in the raised position. The engagement of the base locking portion 106 and the lower bracket 154 by way of the slot pin 110 and the first slot 107, in conjunction with the bias exerted by the biasing element 113 in the "+y" direction, secure the lower bracket 154 from rotation and thereby lock the rear iron sight 10 in the raised position. The projection can have a form other than the slot pin 110; for example, the projection can be unitarily formed with the remainder of the lower bracket 154 in alternative embodiments.

Because the slot pin 110 rotates with the lower bracket 154, the slot pin 110 is positioned generally parallel to a longitudinal axis of the base 102, i.e., the slot pin 110 extends generally horizontally, in the "x" direction, when the rear iron sight 10 is in its lowered position. The base locking portion 106 also may include a horizontally-oriented second slot (not shown) that is aligned with, and receives the slot pin 110 when the rear iron sight 10 is in the lowered position. The engagement of the base locking portion 106 and the lower bracket 154 by way of the slot pin 110 and the second slot, in conjunction with the bias exerted by the biasing element 113, secure the lower bracket 154 from rotation and thereby lock the rear iron sight 10 in the lowered position.

To unlock the lower bracket 154 and rotate the lower bracket 154 between the raised and lowered positions, the user applies a lateral ("−y") direction force to the side of the lower bracket 154 opposite the biasing element 113. The applied force compresses the biasing element 113 and unseats the slot pin 110 from the corresponding first slot 107 or second slot. The lower bracket 154, and the attached upper bracket 156, elevation drum 160, and dual aiming aperture 162, may then be rotated. Once the desired rotation is complete, e.g., once the components rotate about 80° to about 100°, such as about 90°, from their initial locked positions, the slot pin 110 will align with and become seated within the relevant slot, i.e., the first slot 107 or the second slot, thereby securing lower bracket 154 in the new locked position.

As shown in FIG. 1, the lower bracket 154 includes the first portion 170, and an adjoining second portion 172. The second portion 172 has a generally rectangular profile, and defines an internal cavity 174 in which the elevation drum 160 is housed. The first and second portions 170, 172 are unitarily formed; the first and second portions 170, 172 can be formed separately and joined by a suitable means such as welding in alternative embodiments.

An aperture 175 and an aperture 176 are formed in the second portion 172 of the lower bracket 154. The apertures 175, 176 each extend between the cavity 174 and an upper surface 178 of the second portion 172. A bore 180 and a bore 181 are each formed in the second portion 172 and the first portion 170, and extend downwardly from the cavity 174. The bores 180, 181 are visible in FIGS. 1, 7, and 9. The bore 180 is vertically aligned with the aperture 175, and the bore 181 is vertically aligned with the aperture 176, from the perspective of FIG. 1. The functions of the apertures 175, 176 and the bores 180, 181 are discussed below.

Figure 3:
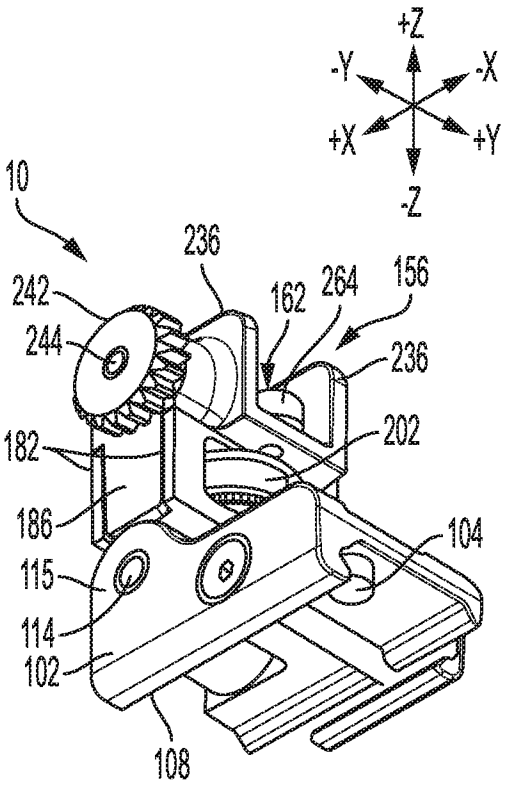
FIG. 3 is a front-bottom perspective view of the rear iron sight of FIG. 1, depicted in a raised locked position.
Figure 2:
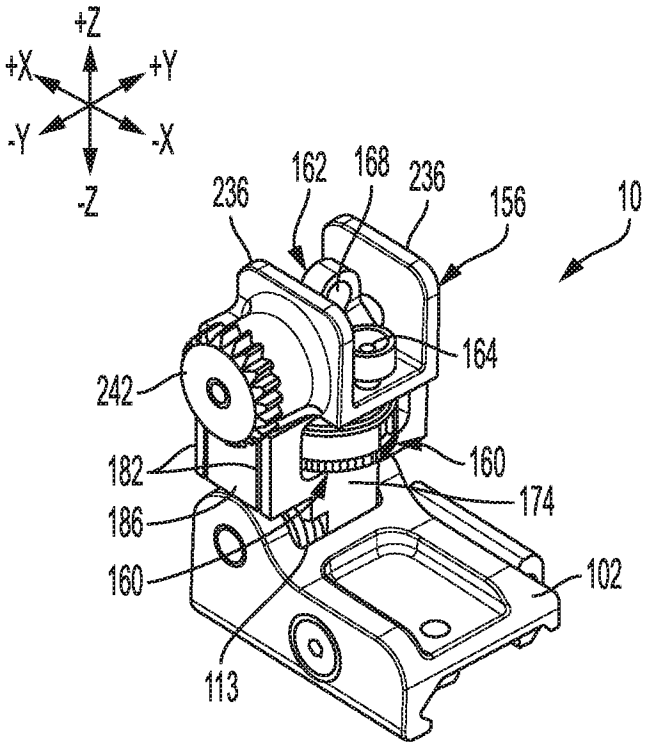
FIG. 2 is a front-top perspective view of the rear iron sight of FIG. 1, depicted in a raised locked position.
Figure 4:
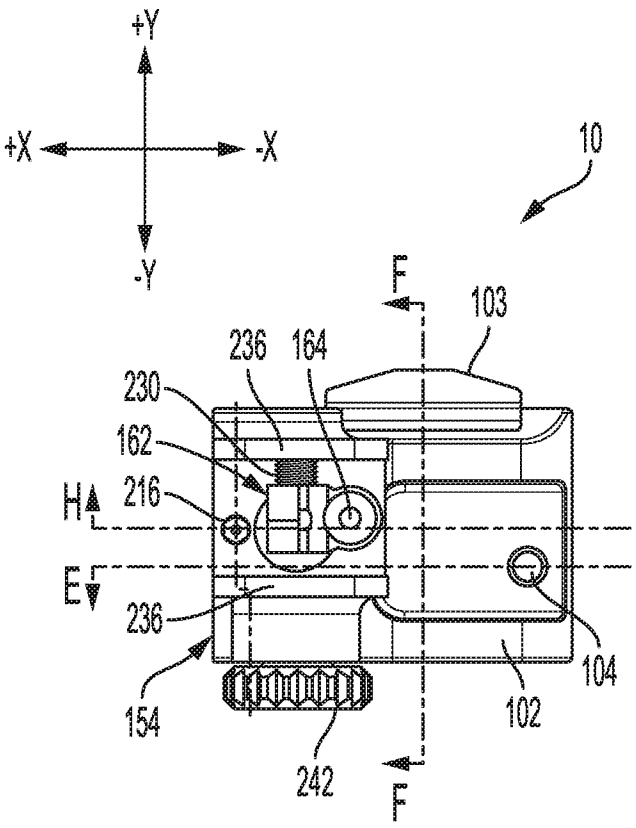
FIG. 4 is a top view of the rear iron sight of FIG. 1, depicted in a raised locked position.

As shown in FIGS. 1-3, the second portion 172 of the lower bracket 154 also includes four rails 182. The rails 182 extend substantially in the vertical, i.e., "z," direction when the sight 10 is in its raised position. The rails 182 are located at the respective corners of the second portion 172. The two rails 182 on each side of the second portion 172, in conjunction with an adjacent outwardly-facing surface 184 of the second portion 172, define a recess 185, visible in FIG. 1.

The upper bracket 156 includes a body 188 and alignment members 186. As depicted herein, the alignment members 186 may be elongated planar extensions that extend downwardly from a horizontally-oriented base portion 193 of the body 188. The alignment members 186 and the body 188 may be unitarily formed. In one embodiment, the alignment members 186 and the body 188 are formed separately and then joined by a suitable means such as welding.

Each alignment member 186 may be positioned within a respective one of the recesses 185 when the upper bracket 156 is mated with the lower bracket 154, and shown in FIGS. 2 and 3. The alignment members 186 are configured so that the outer edges 190 of the alignment members 186 are each positioned adjacent to a respective one of the rails 182, with minimal clearance. Also, each alignment member 186 is spaced apart from the adjacent outwardly-facing surface 184 of the second portion 172, with minimal clearance.

The rails 182 restrain the upper bracket 156 in the "x" direction, and together with the alignment members 186 align the upper bracket 156 with the lower bracket 154 while allowing the upper bracket 156 to move vertically in relation to the lower bracket 154. In addition, interference between the alignment members 186 and the adjacent surfaces 184 of the lower bracket 154 restrains the upper bracket 156 in the "y" direction, and aligns the upper bracket 156 with the lower bracket 154 while allowing the upper bracket 156 to move vertically. Because consistent proper functioning of a firearm's sight is critical to the accuracy of the firearm, maintaining the upper and lower brackets 156, 154 in their proper alignment can help ensure that the accuracy of the rifle 15 is maintained during use of the rear iron sight 10.

The alignment members 186 can have a configuration different than the substantially planar configuration disclosed herein. For example, the alignment members 186 of alternative embodiments may be configured as pins, legs, knobs, dovetails, etc. that engage corresponding bores or other mating features in the lower bracket 154; and the upper bracket 156 may include fewer or more than two of the alignment members 186. Also, the alignment members 186 may be positioned on the lower bracket 154, and the corresponding mating features, e.g., the rails 182 and the recesses 185, may be positioned on the upper bracket 156 in alternative embodiments.

As shown in FIG. 1, the upper bracket 156 also includes a shaft 191 that extends downwardly from the base portion 193 of the body 188. The shaft 191 and the body 188 are unitarily formed; the shaft 191 and the body 188 can be formed separately and joined by a suitable means such as welding in alternative embodiments. The shaft 191 has threads formed on the exterior thereof. An interior of the shaft 191 is hollow, so that the shaft 191 defines an internal passage 192 extending the length thereof. The internal passage is visible in FIG. 7. The purpose of the internal passage 192 is discussed below.

The elevation drum 160 includes a first, or lower knob 200 and a second, or upper knob 202, as illustrated in FIG. 1. The lower knob 200 includes a disc-shaped first portion 204, and a hollow shaft 206 that extends upwardly from the first portion 204. The first portion 204 and the shaft 206 are unitarily formed; the first portion 204 and the shaft 206 can be formed separately and joined by a suitable means such as welding in alternative embodiments.

The first portion 204 can have a serrated outer edge, to assist the user in rotating the elevation drum 160 as discussed below. Detents 210 are formed in an upper surface 212 of the first portion 204. The detents 210 are spaced apart in approximately equal angular increments around the upper surface 212. In one embodiment, 10-20 detents 210 can be formed in the upper surface 212. Each detent 210 may have a conical cross-section, as shown in FIGS. 6, 7, and 9, but the detents 210 may have other alternative shapes as well.

Figure 6:
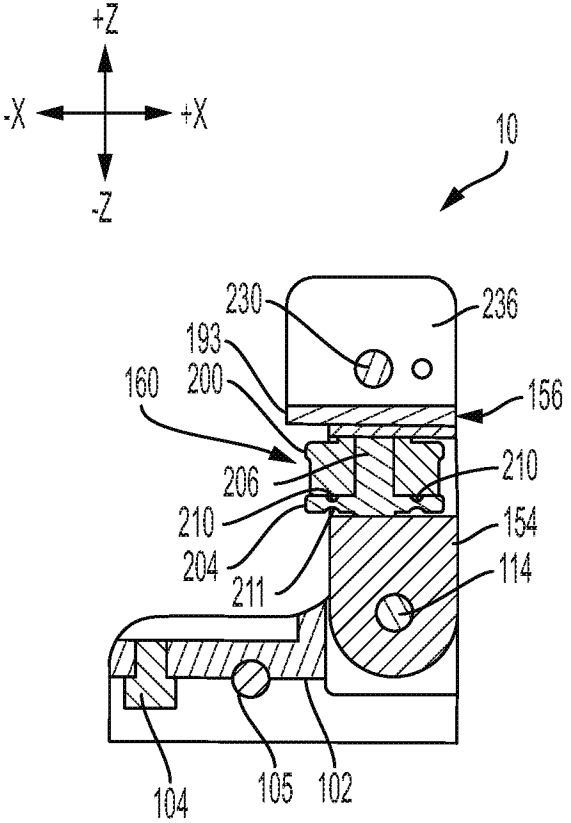
FIG. 6 is a cross-sectional view of the rear iron sight of FIG. 1, taken through the line "E-E" of FIG. 4, depicting the iron sight in a raised locked position.

A lower surface 209 of the first portion 204 has a set of semi-spherical detents 211 formed therein, as shown in FIGS. 6, 7, and 9. Each detent 211 may be substantially aligned with (i.e., may have about the same angular or clock position as) a corresponding one of the detents 210 on the upper surface 212. More, or less than 10-20 of the detents 211 can be formed on the lower surface 209 in alternative embodiments, depending on the desired magnitude of the elevation adjustment per click of the elevation drum 160.

Threads may be formed on the interior surface of the shaft 206, as shown in FIG. 7. These internal threads may be configured to engage the external threads on the shaft 191 of the upper bracket 156. As discussed below, the engagement of the shaft 191 and the shaft 206 by way of their respective threads, couples the upper bracket 156 to the lower bracket 154, and allows the vertical, or "z" direction, position of the upper bracket 156 to be varied in relation to the lower bracket 154. The pitch and other characteristics of the threads are application-dependent, and can vary with factors such as the desired magnitude of the elevation adjustment per click of the elevation drum 160, as discussed below.

Referring to FIG. 1, the upper knob 202 may be ring shaped. The upper knob 202 may be sized to fit over the shaft 206 of the lower knob 200 with minimal clearance between the inner circumferential surface of the upper knob 202 and the outer surface of the shaft 206. This arrangement permits the upper knob 202 to rotate in relation to the lower knob 200. The upper knob 202 can have a serrated outer edge, to assist user in rotating the elevation drum 160.

The upper knob 202 may have two threaded bores 214 formed therein. Each bore 214 receives a corresponding set screw 216, as shown in FIG. 7. The set screws 216 can be inserted into the bores 214 by way of respective apertures 219 formed in the upper bracket 156. A lower end of each set screw 216 has a shape that substantially matches that of the detents 210, as shown in FIG. 7. The bores 214 may be positioned so that each bore 214 aligns with one of the detents 210 in the upper surface 212 of the first portion 204, when the upper knob 202 is oriented in any one of 18 different angular positions in relation to the lower knob 200. When the upper knob 202 is disposed in any one of these 18 positions, the set screws 216 can be advanced in their respective bores 214 so that the ends of each set screw 216 become disposed in a corresponding detent 210. The engagement of the set screws 216 and their corresponding detents 210 secures the upper knob 202 from rotation in relation to the lower knob 200. This feature can be used to calibrate the elevation drum 160 using conventional techniques known in the art.

The elevation drum 160 may be positioned within the cavity 174 formed in the second portion 172 of the lower bracket 154. The forward and rearward ends of the cavity 174 are open, as shown in FIGS. 1-3 and 5, to permit the user to access the elevation drum 160. Minimal clearance is present between the top and bottom of the elevation drum 160 and the adjacent surfaces of the lower bracket 154. The elevation drum 160 is depicted in the figures as a 6/3 drum, but the elevation drum 160 can be an 8/3 drum or other type of drum in alternative embodiments.

As noted above, the upper bracket 156 may be coupled to the lower bracket 154 by the engagement of the shaft 191 of the upper bracket 156 and the shaft 206 of the lower knob 200. The upper bracket 156 may be mated with the lower bracket 154 by aligning the shaft 191 with the shaft 206; bringing the lower end of the shaft 191 into contact with the upper end of the shaft 206 via the aperture 175 in the second portion 172 of the lower bracket 154; and rotating the elevation drum 160. The elevation drum 160 can be rotated by the user by grasping the serrated outer edges of the lower knob 200 and/or the upper knob 202 through the openings in the forward and rearward ends of the cavity 174, and turning the lower knob 200 and/or the attached upper knob 202.

The rotation of the elevation drum 160 imparts a corresponding rotation to the shaft 206, which causes the threads on the shaft 206 to engage those on the shaft 191. Continued rotation of the elevation drum 160 draws the shaft 191 into further engagement with the shaft 206. Because the elevation drum 160 is constrained by the lower bracket 154 in the vertical ("z") direction, the progressive engagement of the shaft 206 and the shaft 191 draws the body 188 of the upper bracket 156 downward, toward the lower bracket 154; and draws the alignment members 186 into the corresponding recesses 185 defined by the lower bracket 154.

Once the upper and lower brackets 156, 154 have been mated in the above manner, turning the lower knob 200 in the opposite direction results in upward movement of the shaft 206, and the rest of the upper bracket 156. Because the dual aiming aperture 162 is mounted on the body 188 of the upper bracket 156, the up and down movement of the upper bracket 156 in relation to the lower bracket 154 facilitates adjustment of the elevation setting for the rear iron sight 10.

The rear iron sight 10 also includes a ball 220 and a spring 222. The spring 222 is positioned within the bore 181 formed in the lower bracket 154 as shown in FIG. 7, and biases the ball 220 upward, from the perspective of FIGS. 1 and 7. The spring 222 can be inserted into the bore 181 by way of the aperture 176 formed in the second portion 172 of the lower bracket 154. The bore 181 is positioned to align with the detents 211 in the lower surface 209 of the lower knob 200. In particular, the bore 181 aligns with a different one of the detents 211 when the lower knob 200 is positioned at each of 18 different angular positions in relation to the lower bracket 154. The ball 220 becomes disposed in a respective one of the detents 211 when that particular detent 211 becomes aligned with the ball 220, and the spring 222 biases the ball 220 into the detent 211. The engagement of the ball 220 and the lower knob 200 by way of the detent 211 restrains the elevation drum 160 from rotation in relation to the lower bracket 154 and the upper bracket 156.

The elevation drum 160 can be rotated by the user by applying sufficient torque to the elevation drum 160 to cause the ball 220 to be urged downward by the surface of the detent 211 as the elevation drum 160 begins to rotate. Continued rotation of the elevation drum 160 eventually forces the ball 220 out of the detent 211, against the bias of the spring 222. The spring bias subsequently causes the ball 220 to enter an adjacent detent 211 when the adjacent detent 211 aligns with the bore 181. The spring-biased ball 220 and the detents 211 provide a tactile and audible click that can provide the user with a positive and reliable indication of how far the elevation drum 160 has been rotated from its starting position.

Thus, to adjust the elevation setting of the rear iron sight 10, the user rotates the elevation drum 160 by turning the lower knob 200 and/or the upper knob 202. The interaction of the ball 220, spring 222, and detents 211 will provide the user with a tactile and audible indication each time the elevation drum 160 rotates through an angular increment of about 20 degrees. This allows the user to keep track of how far the elevation drum 160 has been rotated from its starting position, which in turn indicates the magnitude of the change in the elevation setting. The tactile and audible click also provides the user with a positive indication that the ball 220 has been seated in one of the detents 211 once the elevation drum 160 has been rotated to its desired position.

Figure 5:
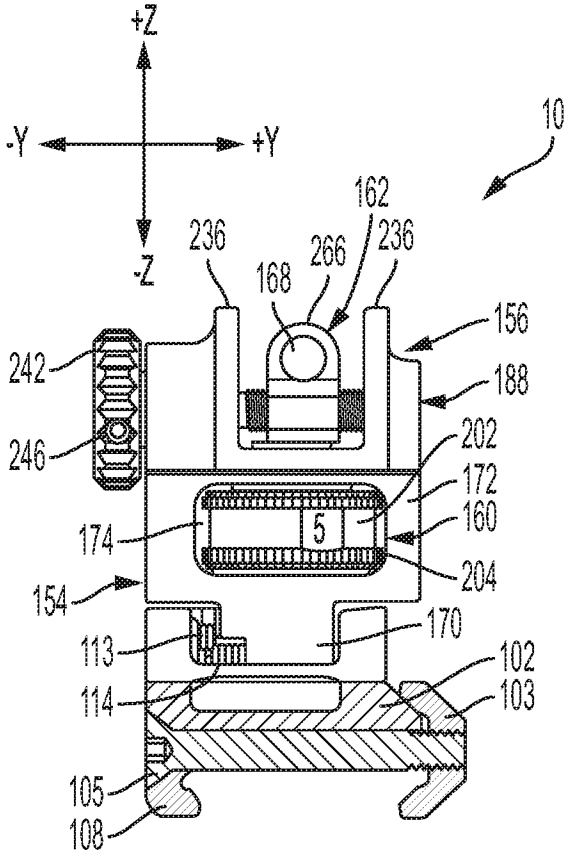
FIG. 5 is a cross-sectional view of the rear iron sight of FIG. 1, taken through the line "F-F" of FIG. 4, depicting the iron sight in a raised locked position.

The aiming aperture 162 may be mounted on the body 188 of the upper bracket 156 (see FIG. 5). The aiming aperture 162 may be configured to rotate in relation to the body 188 between a first position (see FIG. 8) and a second position (see FIGS. 1-5, 7, and 9). Additionally, the aiming aperture 162 may be mounted on a shaft, such as a threaded adjustment screw 230 (see FIGS. 1 and 9), which may be received in a passage 232 formed in the aiming aperture 162. The aiming aperture 162 may have internal threads located in the passage 232. The internal threads engage external threads 234 on the adjustment screw 230. This feature, as discussed below, facilitates adjustment of the lateral ("y") direction position of the aiming aperture 162 in relation to the upper bracket 156, which in turn facilitates adjustment of the windage setting for the rear iron sight 10.

Referring to FIGS. 1 and 9, the adjustment screw 230 may be supported by two vertically-extending members 236 of the body 188. The members 236 extend upwardly from the base portion 193 of the body 188, from the perspective of FIGS. 1 and 9. The members 236 and the base portion 193 are unitarily formed; the members 236 and the base portion 193 can be formed separately, and can be joined by a suitable technique such as welding in alternative embodiments.

The adjustment screw 230 may extend in the lateral ("y") direction through apertures 238 formed in the vertically-extending members 236. A first end portion 240 of the adjustment screw 230 has a larger diameter than the apertures 238, as shown in FIG. 1. The end portion 240 restrains the adjustment screw 230 from movement in the "−y" direction through interference between the end portion 240 and the adjacent surface of the associated vertically-extending member 236.

A knob 242 may be disposed on a second end portion 244 of the adjustment screw 230. The knob 242 may be retained on the second end portion 244 by a pin 246 or other suitable means. The knob 242 restrains the adjustment screw 230 from movement in the "+y" direction through interference between the knob 242 and the adjacent surface of the associated vertically-extending member 236. The knob 242 is biased outwardly, in the "−y" direction, by a ball 248, and a spring 250 disposed in a bore (not shown) formed in the upper bracket 156.

As shown in FIG. 1, the knob 242 may have a plurality (e.g., 10) semi-spherical detents 252 formed in an inwardly-facing surface thereof. The knob 242 can have more or fewer than 10 detents in alternative embodiments, depending on the desired magnitude of the windage adjustment per click of the knob 242. The bore that houses the spring 250 is positioned to align with the detents 252. In particular, the bore aligns with a different one of the detents 252 when the knob 242 is positioned at each often different angular positions in relation to its adjacent vertically-extending member 236. The ball 248 becomes disposed in a respective one of the detents 252 when that particular detent 252 aligns with the ball 248, and the spring 250 biases the ball 248 into the detent 252. The engagement of the ball 248 and the knob 242 by way of the detent 252 restrains the knob 242 from rotation.

The knob 242, and the attached adjustment screw 230, can be rotated by the user by applying sufficient torque to the knob 242 to cause the ball 248 to be urged away from the knob 242 as the knob 242 begins to rotate. Continued rotation of the knob 242 eventually forces the ball 248 out of the detent 252, against the bias of the spring 250. The spring bias subsequently causes the ball 228 to enter the adjacent detent 252 when the adjacent detent 252 becomes aligned with the ball 248. The spring-biased ball 248 and the detents 252 provide a tactile and audible click that can provide the user with a positive and reliable indication of how far the knob 242 has been rotated from its starting position.

Thus, to adjust the windage setting of the rear iron sight 10, the user rotates the knob 242. The interaction of the ball 248, spring 250, and detents 252 will provide the user with a tactile and audible indication each time the knob 242 and the attached adjustment screw 230 rotate through an angular increment of about 36 degrees. This allows the user to keep track of how far the knob 242 and the adjustment screw 230 have been rotated from their respective starting positions, which in turn indicates the magnitude of the change in the windage setting; and provides a positive indication that the ball 220 has been seated in one of the detents 211 once the elevation drum 160 has been rotated to its desired position.

Referring to FIGS. 1 and 7-9, the dual aiming aperture 162 includes a first portion 264 having the first aperture 164 formed therein; and a second portion 266 having the second aperture 168 formed therein. The first and second portions 264, 266 are generally perpendicular to each other. The first portion 264 has an outer surface 272; and the second portion 266 has an outer surface 274. The aiming aperture 162 also includes a third surface 277. The third surface 277 is positioned between the outer surface 272 and the outer surface 274, and adjoins each of the outer surfaces 272, 274 at an obtuse angle.

The aiming aperture 162 is configured to rotate on the adjustment screw 230 between its first and second positions. The aiming aperture 162 is restrained in the first and second positions by a button member 260 and a spring 262. As shown in FIG. 7, the spring 262 extends through the internal passage 192 within the shaft 191 of the upper bracket 156, and into the bore 180 within the lower bracket 154.

The button member 260 may have a disk-shaped first portion 267, and a substantially cylindrical second portion 268 that adjoins the first portion 267. The first and second portions 267, 268 may be unitarily formed. In some embodiments, the first and second portions 267, 268 may be formed separately, and then joined by a suitable technique such as welding.

The second portion 268 of the button member 260 may be positioned within the internal passage 192 of the shaft 191, as shown in FIGS. 7 and 9. The first portion 267 may be located within a recess 269 formed in the base portion 193 of the body 188 of the upper bracket 156. The base portion 193 may include an aperture 270, a portion of which is visible in FIG. 1, through which the second portion 268 extends into the interior of the shaft 191.

As shown in FIG. 7, the outer surface 272 of the first portion 264 of the dual aiming aperture 162 faces the first portion 267 of the button member 260, and the spring 262 biases the first portion 267 into contact with the outer surface 272 when the aiming aperture 162 is in its second position. The bias of the spring 262 is selected so that the upward force exerted by the button member 260 on the outer surface 272 is sufficient to prevent the aiming aperture 162 from being rotated to its first position until an external torque acting on the aiming aperture 162 exceeds a predetermined level.

The user can move the dual aiming aperture 162 to its first position by pushing or otherwise exerting a force on the aiming aperture 162 that results in torque sufficient to overcome the bias of the spring 262. The aiming aperture 162 will begin to rotate toward the second position when the predetermined torque level, acting in the appropriate direction, is reached. At this point, the aiming aperture 162 will urge the button member 260 downward and further into the recess 269.

Continued rotation of the aiming aperture 162 brings the third outer surface 277 into contact with the first portion 267 of the button member 260. The angled orientation of the outer surface 277 in relation to the outer surfaces 272, 274 permits the aiming aperture 162 to rotate between its first and second positions with minimal deflection of the button member 260, which can help maintain a compact configuration for the rear iron sight 10.

Further rotation of the aiming aperture 164 causes the outer surface 274 of the second portion 266 to face and come into contact with the first portion 267 as the aiming aperture 162 reaches its first position. The button member 260 will move upward, under the bias of the spring 262, as the aiming aperture 162 approaches its first position. The first portion 267 of the button member 260 will be driven upward, into contact with the outer surface 274 of the second portion 266, as the aiming aperture 162 reaches its first position. At this point, the bias of the spring 262 will prevent the aiming aperture 162 from being rotated back to its second position until an external torque, acting on the aiming aperture 162 in a direction opposite the previously-applied toque, exceeds the predetermined value, or a second predetermined value.

Thus, the button member 260 and the spring 262 maintain the aiming aperture 162 in its first and second positions, while permitting the user to switch the position of the aiming aperture 162 substantially instantaneously with a single hand movement, without needing to actuate any switches, buttons, keys, etc., and without increasing the overall size of the rear iron sight 10.

Methods for operating a foldable rear back up iron sight using the above disclosed embodiments are provided. In some embodiments, the methods include securing the rear back up iron sight disclosed herein to a rail or upper receiver of a firearm. The rear iron sight may be secured to the rail or upper receiver while in the locked lowered or locked raised position. Once secured to the rail or upper receiver, the rear iron sight may be raised or lowered using a locking mechanism such as a spring assisted locking mechanism as described above. The elevation setting of the rear iron sight may be adjusted by rotating an elevation drum of the rear iron sight; and the windage setting of the rear iron sight may be adjusted by rotating a knob of the rear iron sight.

As used herein, the term "about" in reference to a numerical value means plus or minus 10% of the numerical value of the number with which it is being used.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A rear sight for a firearm, comprising:

a first bracket comprising a first rail and a second rail;

a second bracket;

an elevation drum mounted on and restrained by the first bracket and configured to engage the second bracket so that rotation of the elevation drum in relation to the second bracket varies a position of the second bracket in relation to the first bracket in a first direction; and an aiming aperture mounted on the second bracket, wherein the first or second bracket comprises an alignment member configured to engage the first or second bracket to maintain the first and second brackets in alignment as the position of the second bracket in relation to the first bracket is varied, the alignment member comprising an extension from the second bracket;

the aiming aperture comprises a first and a second aperture defined therein, the aiming aperture being configured to rotate in relation to the second bracket between a first angular position and a second angular positions;

the first and second rails and an adjacent surface of the first bracket define a recess that receives the extension;

the first and the second rails are configured to restrain the extension in a second direction substantially perpendicular to the first direction when the extension is positioned within the recess; and the first and second rails and the adjacent surface are configured to restrain the second bracket in a third direction substantially perpendicular to the first and second directions when the extension is positioned within the recess.

2. The rear sight of claim 1, wherein the extension is substantially planar.

3. The rear sight of claim 1, wherein the alignment member further comprises a second extension on the second bracket; and the first bracket further comprises a third and a fourth rail.

4. The rear sight of claim 1, wherein:

the second bracket comprises a first shaft extending substantially in the first direction and having threads on an exterior surface thereof;

the elevation drum comprises a second shaft extending substantially in the first direction and having threads on an interior surface thereof; and the elevation drum threadably engages the second bracket by way of the first and second shafts.

5. The rear sight of claim 1, wherein the second bracket comprises a body, and the alignment member extends from the body.

6. The rear sight of claim 4, further comprising a third shaft mounted for rotation on the body of the second bracket; wherein the aiming aperture threadably engages the third shaft and is configured to move in a second direction substantially perpendicular to the first direction in response to rotation of the third shaft.

7. A rear sight for a firearm, comprising:

a first bracket;

a second bracket;

an elevation drum mounted on and restrained by the first bracket and configured to engage the second bracket so that rotation of the elevation drum in relation to the second bracket varies a position of the second bracket in relation to the first bracket in a first direction; and an aiming aperture mounted on the second bracket, wherein the first or second bracket comprises an alignment member configured to engage the first or second bracket to maintain the first and second brackets in alignment as the position of the second bracket in relation to the first bracket is varied; and the aiming aperture comprises a first and a second aperture defined therein, the aiming aperture being configured to rotate in relation to the second bracket between a first angular position and a second angular position; and a button member configured to inhibit the rotational movement of the aiming aperture between the first and second angular positions.

8. The rear sight of claim 7, wherein:

the button member comprises a substantially planar first portion configured to contact the aiming aperture, and a substantially cylindrical second portion adjoining the first portion; and the rear sight further comprises a spring disposed within the first shaft and configured to bias the button member toward the aiming aperture.

9. The rear sight of claim 8, wherein the body comprises a recess formed therein and configured to receive the first portion of the button member.

10. The rear sight of claim 8, wherein the aiming aperture comprises:

a first outer surface configured to contact the first portion of the button member when the aiming aperture is in the first angular position;

a second outer surface configured to contact the first portion of the button member when the aiming aperture is in the second angular position; and a third outer surface adjoining each of the first and second outer surfaces at a obtuse angle.

11. A rear sight for a firearm, comprising:

a first bracket;

a second bracket;

an elevation drum mounted on and restrained by the first bracket and configured to engage the second bracket so that rotation of the elevation drum in relation to the second bracket varies a position of the second bracket in relation to the first bracket in a first direction;

an aiming aperture mounted on the second bracket;

a rail mount comprising a base, a clamp, and a rail pin; and a locking mechanism having an axle and a biasing element; wherein the biasing element is configured to bias the first bracket and the locking portion of the base into interlocking engagement when the first bracket is located in each of the first and second positions;

wherein the first or second bracket comprises an alignment member configured to engage the first or second bracket to maintain the first and second brackets in alignment as the position of the second bracket in relation to the first bracket is varied;

the first bracket is coupled to the base and is configured to rotate between a first position corresponding to a lowered locked position of the rear sight, and a second position corresponding to a raised locked position of the rear sight; and the first bracket and a locking portion of the base are configured to interlock when the first bracket is disposed in each of the first and second positions, and the interlocking of the first bracket and the locking portion prevents rotation of the first bracket between the first and second positions.

12. The rear sight of claim 11, wherein the biasing element is further configured to compress and deflect when a force is applied to the first bracket; and the first bracket and the locking portion are further configured so that the deflection of the biasing element releases the first bracket and the locking portion from interlocking engagement thereby permitting the first bracket to rotate between the first and second positions.

13. The rear sight of claim 11, wherein:

the first bracket comprises a projection;

the locking portion of the base comprises a first slot formed therein and configured to receive a portion of the projection when the first bracket is located in the first position; and the engagement of the locking portion and the first bracket by way of the projection and the second slot locks the first bracket in the first position.

14. The rear sight of claim 11, wherein the locking portion of the base comprises a second slot formed therein and configured to receive the portion of the projection when the first bracket is located in the second position; and the engagement of the locking portion and the first bracket by way of the projection and the second slot locks the first bracket in the second position.

15. The rear sight of claim 12, wherein the first bracket and the locking portion of the base are configured so that the deflection of the biasing member permits the projection to back out of the first and the second slots.

16. The rear sight of claim 11, wherein the rail pin and the clamp are configured to secure the base to a rail of a firearm.

17. A firearm, comprising the rear sight of claim 1.

18. The rear sight of claim 12, wherein the biasing element is a spring.

19. A firearm, comprising the rear sight of claim 11.

20. A firearm, comprising the rear sight of claim 7.

21. A rear sight for a firearm, comprising:

a first bracket;

a second bracket comprising a first rail and a second rail;

an elevation drum mounted on and restrained by the first bracket and configured to engage the second bracket so that rotation of the elevation drum in relation to the second bracket varies a position of the second bracket in relation to the first bracket in a first direction; and an aiming aperture mounted on the second bracket, wherein:

the first bracket comprises an alignment member, the alignment member comprising an extension from the first bracket configured to engage the second bracket to maintain the first and second brackets in alignment as the position of the second bracket in relation to the first bracket is varied;

the first and second rails and an adjacent surface of the second bracket define a recess that receives the extension;

the first and the second rails are configured to restrain the first bracket in a second direction substantially perpendicular to the first direction when the extension is positioned within the recess;

the first and second rails and the adjacent surface are configured to restrain the first bracket in a third direction substantially perpendicular to the first and second directions when the extension is positioned within the recess; and the aiming aperture comprises a first and a second aperture defined therein, the aiming aperture being configured to rotate in relation to the second bracket between a first angular position and a second angular position.

22. The rear sight of claim 21, wherein the extension is substantially planar.

23. The rear sight of claim 21, wherein the alignment member further comprises a second extension on the second bracket; and the first bracket further comprises a third and a fourth rail.

24. The rear sight of claim 21, wherein:

the second bracket comprises a first shaft extending substantially in the first direction and having threads on an exterior surface thereof;

the elevation drum comprises a second shaft extending substantially in the first direction and having threads on an interior surface thereof; and the elevation drum threadably engages the second bracket by way of the first and second shafts.

25. The rear sight of claim 24, wherein, further comprising a third shaft mounted for rotation on the body of the second bracket; wherein the aiming aperture is threadably engages the third shaft and is configured to move in a second direction substantially perpendicular to the first direction in response to rotation of the third shaft.

26. The rear sight of claim 21, wherein the second bracket comprises a body, and the alignment member extends from the body.

27. A firearm, comprising the rear sight of claim 21.

* * * * *